US009808687B1

(12) United States Patent
Kalcich

(10) Patent No.: US 9,808,687 B1
(45) Date of Patent: Nov. 7, 2017

(54) GOLF TEE ASSEMBLY

(71) Applicant: Matthew Kalcich, Lewisburg, PA (US)

(72) Inventor: Matthew Kalcich, Lewisburg, PA (US)

( * ) Notice: Subject to any disclaimer, the term of this patent is extended or adjusted under 35 U.S.C. 154(b) by 0 days.

(21) Appl. No.: 15/346,117

(22) Filed: Nov. 8, 2016

(51) Int. Cl.
*A63B 57/15* (2015.01)

(52) U.S. Cl.
CPC ..... *A63B 57/15* (2015.10)

(58) Field of Classification Search
CPC ..... A63B 57/10; A63B 57/12; A63B 57/13; A63B 57/15; A63B 57/16; A63B 57/19
USPC ..... D21/717
See application file for complete search history.

(56) References Cited

U.S. PATENT DOCUMENTS 2,074,519 A * 3/1937 Shephard ..... A63B 57/10 473/390
2,160,122 A 5/1939 Bundy
2,555,222 A * 5/1951 Coleman ..... A63B 57/10 131/256
3,141,671 A * 7/1964 Eyer ..... A63B 57/10 248/163.1
D202,359 S * 9/1965 Harris ..... 473/387
3,559,998 A * 2/1971 Kelly ..... A63B 57/10 273/DIG. 4
5,310,189 A * 5/1994 Soto ..... A63B 59/00 273/DIG. 8
6,280,350 B1 * 8/2001 Chung ..... A63B 57/10 473/387
6,682,443 B1 * 1/2004 Liu ..... A63B 57/10 473/387
7,448,967 B1 * 11/2008 Panneri ..... A63B 57/10 473/387
D641,813 S * 7/2011 Bowen ..... D21/717
8,323,125 B2 12/2012 Bowen
2005/0148410 A1 * 7/2005 DeLisle ..... A63B 57/10 473/387
2008/0064517 A1 * 3/2008 Stuart ..... A63B 57/10 473/132
2012/0088609 A1 * 4/2012 Bowen ..... A63B 57/10 473/392

FOREIGN PATENT DOCUMENTS

WO WO2008033735 3/2008

* cited by examiner

*Primary Examiner* — Steven Wong

(57) ABSTRACT

A golf tee assembly includes a support that has a plurality of arms. The support may be positioned on a support surface to define a vertically oriented arm and a plurality of supporting arms. A plurality of tees is provided and each of the tees is removably coupled to the support. The tee corresponding to the vertically oriented arm may support a golf ball thereby facilitating the golf ball to be struck. A plurality of extensions is provided. Each of the extensions is removably positioned between the arms and the tees. Thus, the tees are spaced a selected distance from the support.

9 Claims, 5 Drawing Sheets

GOLF TEE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention.

(2) Description of Related Art Including Information Disclosed Under 37 CFR 1.97 and 1.98.

The disclosure and prior art relates to tee devices and more particularly pertains to a new tee device for supporting a golf ball during game play.

BRIEF SUMMARY OF THE INVENTION

An embodiment of the disclosure meets the needs presented above by generally comprising a support that has a plurality of arms. The support may be positioned on a support surface to define a vertically oriented arm and a plurality of supporting arms. A plurality of tees is provided and each of the tees is removably coupled to the support. The tee corresponding to the vertically oriented arm may support a golf ball thereby facilitating the golf ball to be struck. A plurality of extensions is provided. Each of the extensions is removably positioned between the arms and the tees. Thus, the tees are spaced a selected distance from the support.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
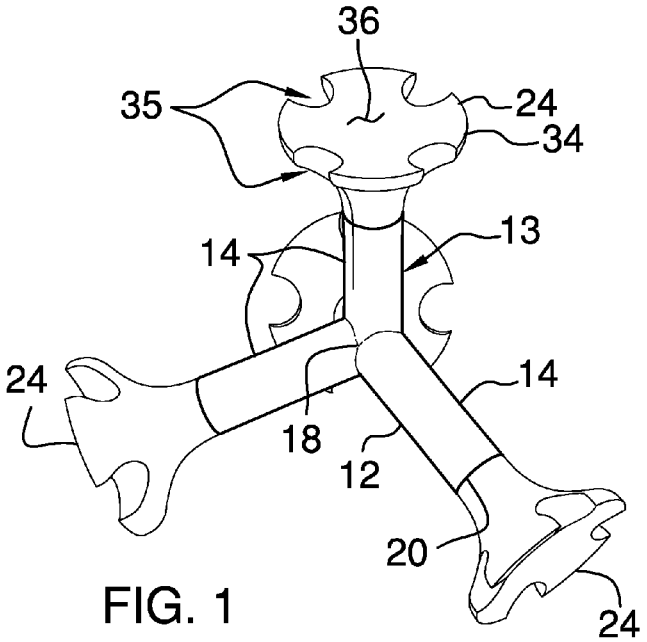
FIG. 1 is a top perspective view of a golf tee assembly according to an embodiment of the disclosure.
Figure 2:
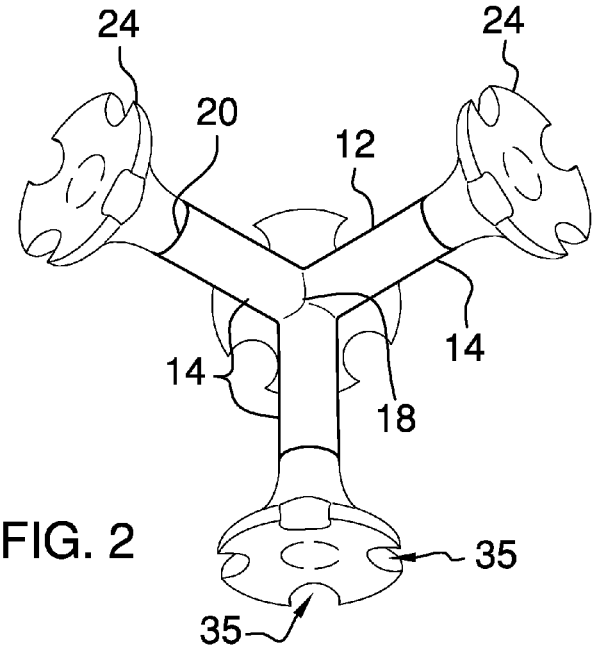
FIG. 2 is a bottom view of an embodiment of the disclosure.
Figure 3:
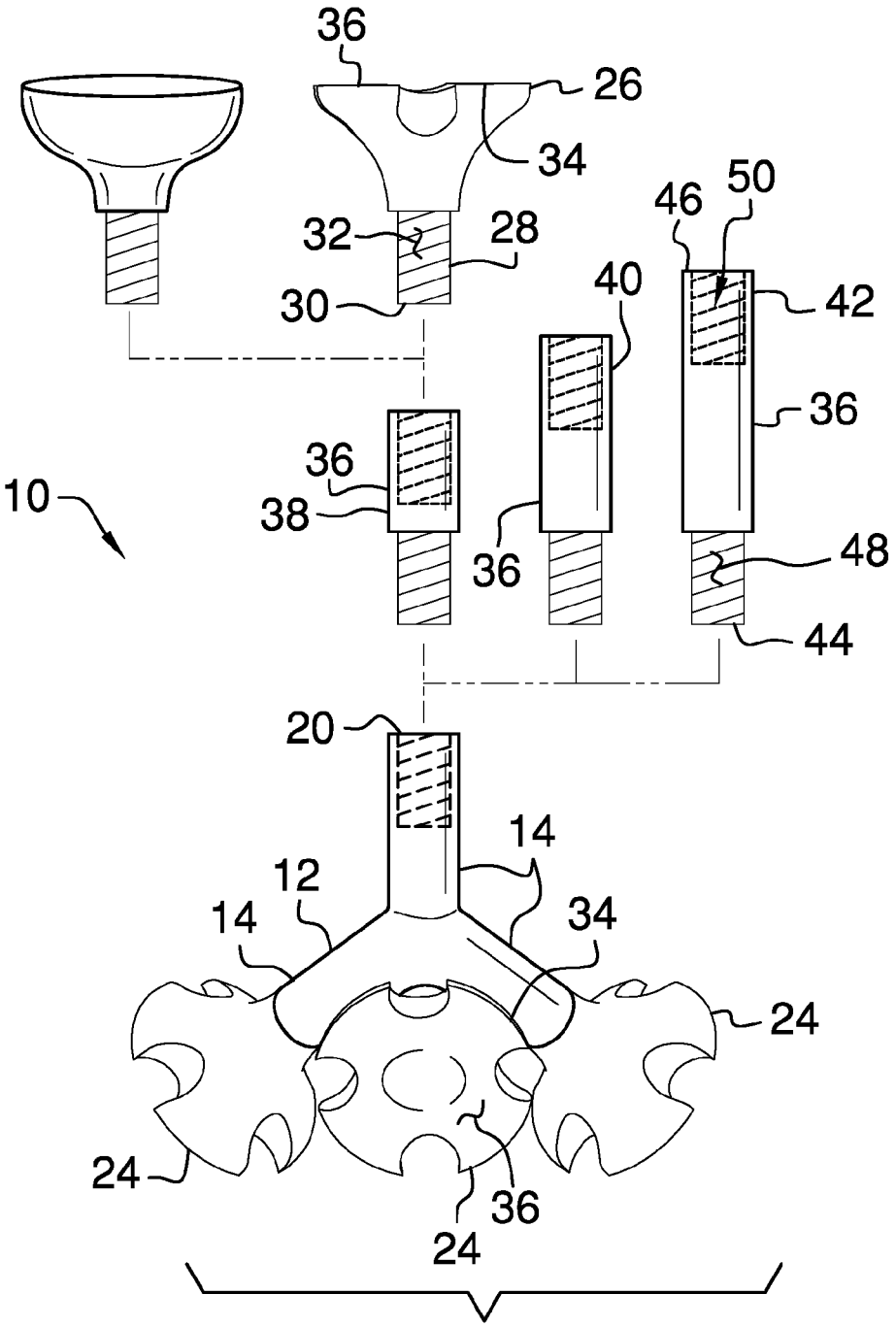
FIG. 3 is an exploded perspective view of an embodiment of the disclosure.
Figure 4:
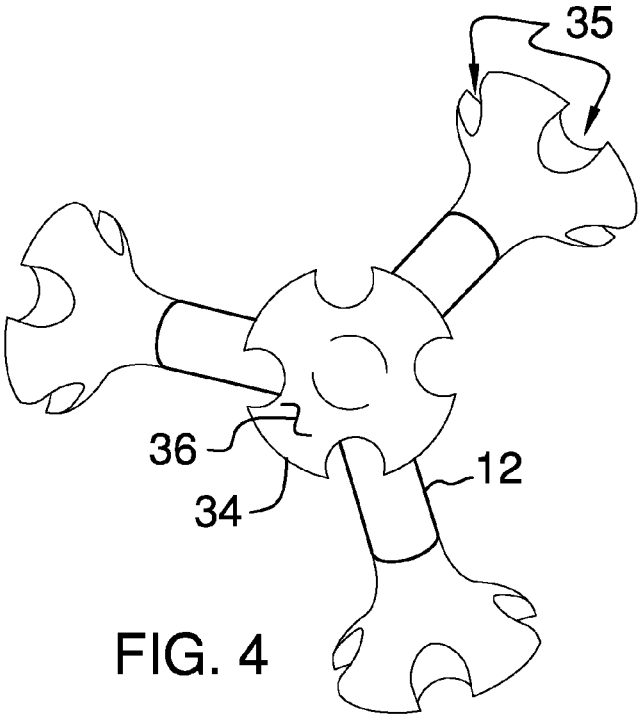
FIG. 4 is a top view of an embodiment of the disclosure.
Figure 5:
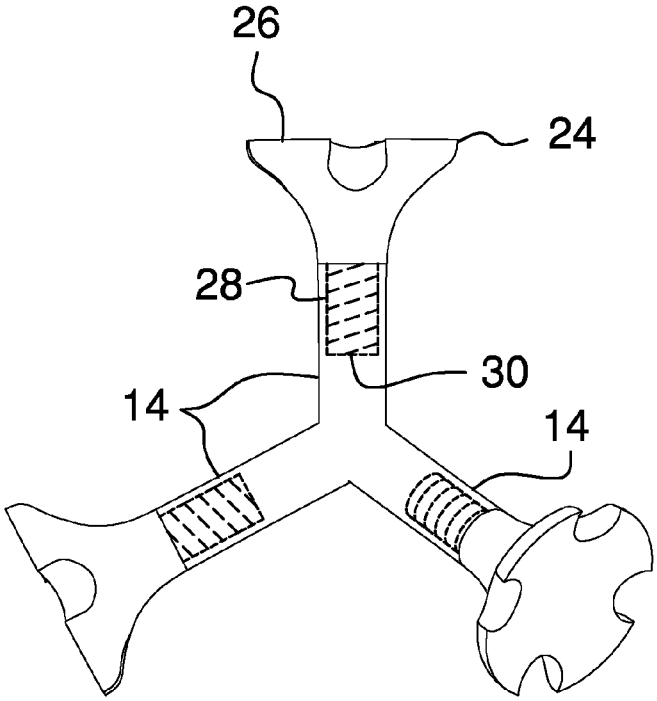
FIG. 5 is a right side phantom view of an embodiment of the disclosure.

With reference now to the drawings, and in particular to FIGS. 1 through 8 thereof, a new tee device embodying the principles and concepts of an embodiment of the disclosure and generally designated by the reference numeral 10 will be described.

As best illustrated in FIGS. 1 through 8, the golf tee assembly 10 generally comprises a support 12 that has a plurality of arms 14. The support 12 may be positioned on a support surface 16 to define a vertically oriented arm 13 and a plurality of supporting arms 15. The support surface 16 may be ground on a golf course or the like. Each of the arms 14 radiates outwardly from a center point 18 of the support 12.

Each of the arms 14 forms an angle with respect to each other. The angle ranges between one hundred degrees and one hundred ten degrees. Each of the arms 14 has a distal end 20 with respect to the center point 18 and the distal end 20 corresponding to each of the arms 14 defines a point on a sphere. The distal end 20 corresponding to each of the arms 14 is open.

A plurality of tees 22 is provided. Each of the tees 22 is removably coupled to the support 12. The tee corresponding to the vertically oriented arm may support 12 a golf ball 24. Thus, the golf ball 24 may be struck during game play.

Each of the tees 22 comprises a head 26 and a stem 28. The stem 28 has a distal end 30 with respect to the head 26 and an outer surface 32. The outer surface 32 is threaded. The stem 28 corresponding to each of the tees 22 is inserted into the distal end 20 of a selected one of the arms 14. Moreover, the stem 28 corresponding to each of the tees 22 threadably engages the selected arm 14 such that each of the tees 22 is removably coupled to the selected arm 14.

The head 26 has an outer edge 33 and a top surface 34. The outer edge 33 has a plurality of slots 35 and each of the slots 35 extends toward the stem 28. The slots 35 are spaced apart from each other and are distributed around the outer edge 33. The outer edge 33 of the tees 22 corresponding to the supporting arms 14 engages the support surface 16. The top surface 34 corresponding to each of the tees 22 is concavely arcuate with respect to the outer edge 33. The golf ball 24 corresponding to the vertically oriented arm may be positioned on the top surface 34 of the associated tee.

A plurality of extensions 36 is provided. Each of the extensions 36 is selectively and removably positioned between the arms 14 and the tees 22. Thus, the tees 22 are spaced a selected distance from the support 12. The plurality of extensions 36 includes a set of short extensions 38, a set of medium extensions 40 and a set of long extensions 42. Each of the short extensions 38 may have a length ranging between twelve mm and fourteen mm. Each of the medium extensions 40 may have a length ranging between eighteen and twenty mm. Each of the long extensions 42 may have a length ranging between twenty four mm and twenty six mm.

Each of the extensions 36 has a first end 44, a second end 46 and an exterior surface 48 extending therebetween. The exterior surface 48 is threaded adjacent to the first end 44. The second end 46 has a well 50 extending toward the first end 44. The distal end 20 corresponding to each of the arms 14 insertably receives the first end 44 of an associated one of the extensions 36. The second end 46 corresponding to each of the extensions 36 insertably receives the distal end 20 corresponding to an associated one of the tees 22.

Figure 6:
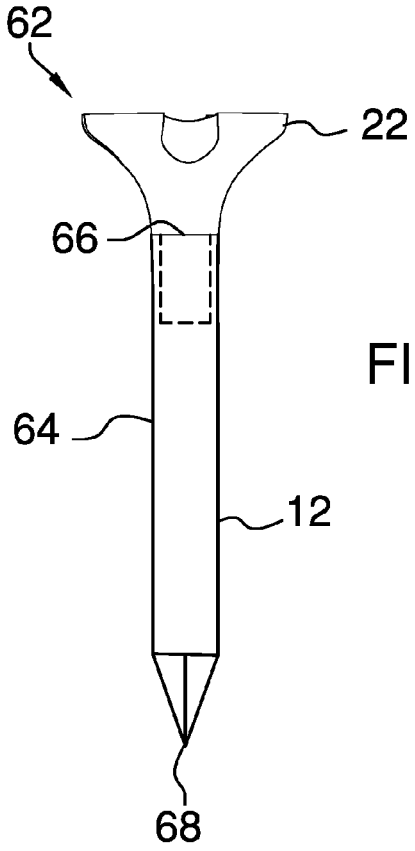
FIG. 6 is a perspective view of an alternative embodiment of the disclosure.
Figure 7:
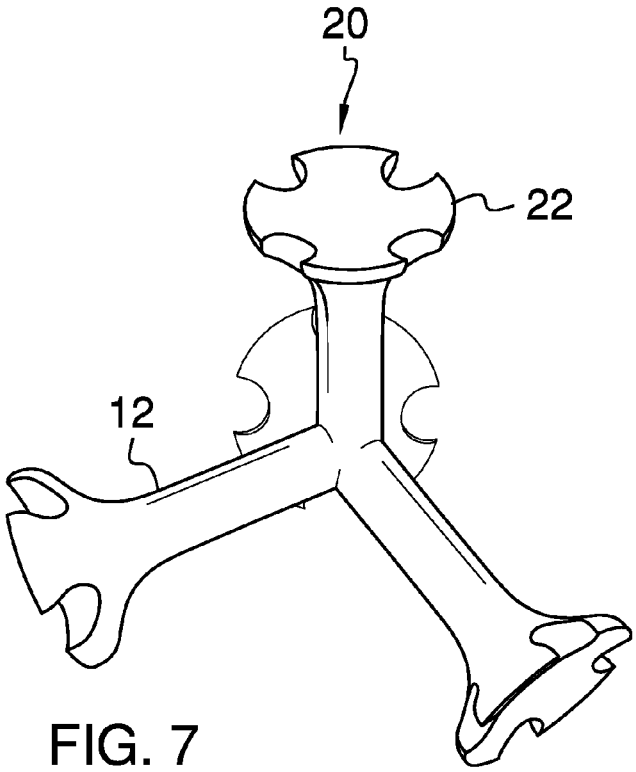
FIG. 7 is a front perspective view of an alternative embodiment of the disclosure.
Figure 8:
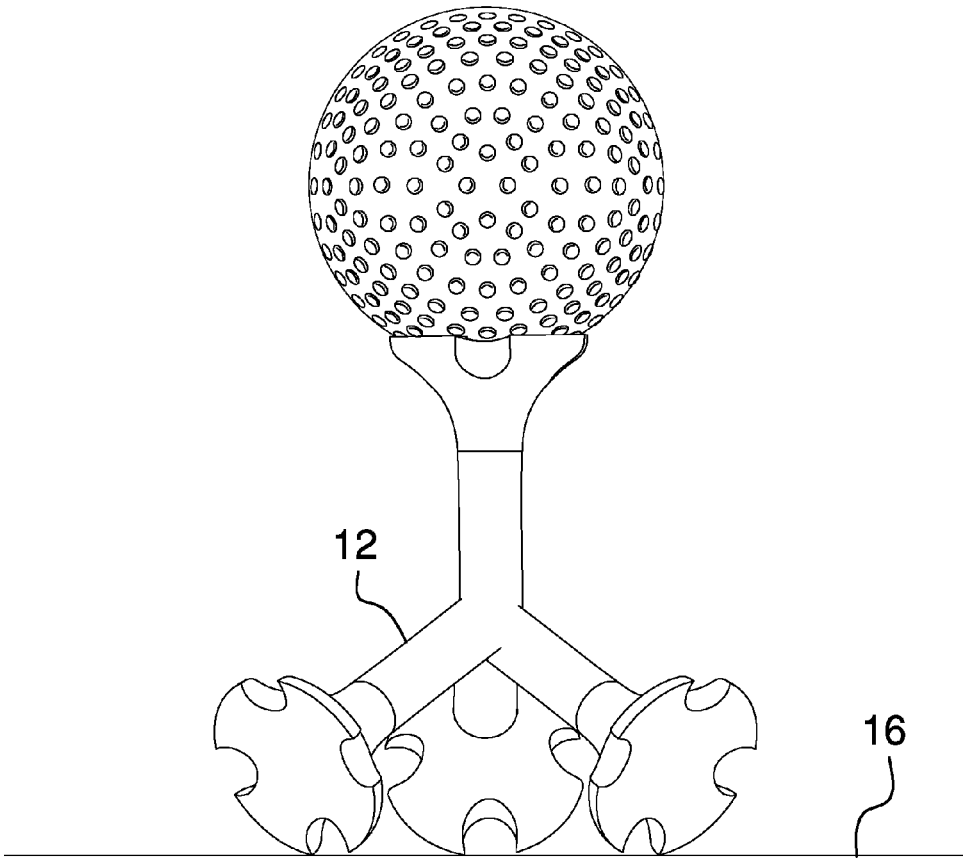
FIG. 8 is a perspective in-use view of an alternative embodiment of the disclosure.

In an alternative embodiment 62 as shown in FIG. 6, the support 12 may comprise a stake 64 with an upper end 66 and a lower end 68. The upper end 66 may be open and the upper end 66 may insertably receive the distal end 30 of the tee 22. The lower end 68 may penetrate the ground. Thus, the stake 64 is vertically oriented to support the golf ball 24. In an alternative embodiment 70 as shown in FIG. 7, each of the arms 14 and each of the tees 22 may be integral components of the support 12.

In use, each of the tees 22 is threadably coupled to an associated one of the arms 14. The support 12 is placed on the ground. One of the arms 14 is vertically oriented regardless of how the support 12 is oriented on the ground. The golf ball 24 is placed on the tee 22 corresponding to the vertically oriented arm 13. Each of the extensions 36 is selectively positioned between an associated pair of arms 14 and the tees 22. Thus, the golf ball 24 may be positioned above grass or other obstructions on the golf course.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf tee assembly being configured to support a golf ball without penetrating ground, said assembly comprising:

a support having a plurality of arms, said support being configured to be positioned on a support surface to define a vertically oriented arm and a plurality of supporting arms;

a plurality of tees, each of said tees being removably coupled to said support, said tee corresponding to said vertically oriented arm being configured to support a golf ball thereby facilitating the golf ball to be struck; and a plurality of extensions, each of said extensions being removably positioned between said arms and said tees, said plurality of extensions including a set of short extensions, a set of medium extensions, and a set of long extensions such that said tees are positionable to be spaced a selected distance from said support.

2. The assembly according to claim 1, further comprising said plurality of arms radiating outwardly from a center point of said support, each of said arms forming an angle with respect to each other.

3. The assembly according to claim 2, wherein said angle ranges between one hundred degrees and one hundred ten degrees.

4. The assembly according to claim 2, wherein each of said arms having a distal end with respect to said center point such that said distal end corresponding to each of said arms defines a point on a sphere, said distal end corresponding to each of said arms being open.

5. The assembly according to claim 1, wherein:

each of said arms has a distal end; and each of said tees includes a head and a stem, said stem having a distal end with respect to said head and an outer surface, said outer surface being threaded, said stem corresponding to each of said tees being inserted into said distal end of a selected one of said arms, said stem corresponding to each of said tees threadably engaging said selected arm such that each of said tees is removably coupled to said selected arm.

6. The assembly according to claim 5, wherein said head has an outer edge and a top surface, said outer edge having a plurality of slots, each of said slots extending toward said stem, said slots being spaced apart from each other and being distributed around said outer edge, said outer edge of said tees corresponding to said supporting arms being configured to engage the support surface.

7. The assembly according to claim 6, wherein said top surface corresponding to each of said tees is concavely arcuate with respect to said outer edge, said top surface corresponding to said vertically oriented arm being configured to have the golf ball positioned thereon.

8. The assembly according to claim 1, wherein:

each of said arms has a distal end;

each of said tees has a distal end; and each of said extensions has a first end, a second end and an exterior surface extending therebetween, said exterior surface being threaded adjacent to said first end, said second end having a well extending toward said first end, said distal end corresponding to each of said arms insertably receiving said first end of an associated one of said extensions, said second end corresponding to each of said extensions insertably receiving said distal end corresponding to an associated one of said tees.

9. A golf tee assembly being configured to support a golf ball without penetrating ground, said assembly comprising:

a support having a plurality of arms, said support being configured to be positioned on a support surface to define a vertically oriented arm and a plurality of supporting arms, said plurality of arms radiating outwardly from a center point of said support, each of said arms forming an angle with respect to each other, said angle ranging between one hundred degrees and one hundred ten degrees, each of said arms having a distal end with respect to said center point such that said distal end corresponding to each of said arms defines a point on a sphere, said distal end corresponding to each of said arms being open;

a plurality of tees, each of said tees being removably coupled to said support, said tee corresponding to said vertically oriented arm being configured to support a golf ball thereby facilitating the golf ball to be struck, each of said tees comprising a head and a stem, said stem having a distal end with respect to said head and an outer surface, said outer surface being threaded, said stem corresponding to each of said tees being inserted into said distal end of a selected one of said arms, said stem corresponding to each of said tees threadably engaging said selected arm such that each of said tees is removably coupled to said selected arm, said head having an outer edge and a top surface, said outer edge having a plurality of slots, each of said slots extending toward said stem, said slots being spaced apart from each other and being distributed around said outer edge, said outer edge of said tees corresponding to said supporting arms being configured to engage the support surface, said top surface corresponding to each of said tees being concavely arcuate with respect to said outer edge, said top surface corresponding to said vertically oriented arm being configured to have the golf ball positioned thereon; and a plurality of extensions, each of said extensions being removably positioned between said arms and said tees, said plurality of extensions including a set of short extensions, a set of medium extensions, and a set of long extensions such that said tees are positionable to be spaced a selected distance from said support, each of said extensions having a first end, a second end and an exterior surface extending therebetween, said exterior surface being threaded adjacent to said first end, said second end having a well extending toward said first end, said distal end corresponding to each of said arms insertably receiving said first end of an associated one of said extensions, said second end corresponding to each of said extensions insertably receiving said distal end corresponding to an associated one of said tees.

* * * * *